US006324868B1

(12) United States Patent
Chen et al.

(10) Patent No.: US 6,324,868 B1
(45) Date of Patent: Dec. 4, 2001

(54) CUSTOMIZABLE PENDANT

(75) Inventors: Felix Yuan-Chi Chen; Joseph A. Corso; Samuel Schildcrout, all of Dallas, TX (US)

(73) Assignee: PAJ, Inc.

( * ) Notice: Subject to any disclaimer, the term of this patent is extended or adjusted under 35 U.S.C. 154(b) by 0 days.

(21) Appl. No.: 09/432,188

(22) Filed: Nov. 2, 1999

(51) Int. Cl.[7] ..... A44C 13/00

(52) U.S. Cl. ..... 63/1.14; 63/23

(58) Field of Search ..... 63/1.14, 1.15, 63/23, 26

(56) References Cited

U.S. PATENT DOCUMENTS

| | | | | |
|---|---|---|---|---|
| 1,385,288 | * | 7/1921 | Walker | 132/328 |
| 1,625,375 | * | 4/1927 | Reyes | 63/1.15 |
| 1,730,257 | * | 10/1929 | Welch | 63/32 |
| 2,194,379 | * | 3/1940 | Bicks | 63/1.14 |
| 2,751,764 | * | 6/1956 | Hudes et al. | 63/21 |
| 4,208,888 | * | 6/1980 | Erdman et al. | 63/3 |
| 4,712,389 | * | 12/1987 | Innis | 63/1.14 |
| 5,390,510 | * | 2/1995 | Tirio-Cloonan | 63/1.15 |
| 5,476,194 | * | 12/1995 | Hippely et al. | 222/192 |

FOREIGN PATENT DOCUMENTS

| | | | | |
|---|---|---|---|---|
| 1337452 | * | 8/1963 | (FR) | 63/1.1 |

* cited by examiner

*Primary Examiner*—B. Dayoan
*Assistant Examiner*—Andrea Chop
(74) *Attorney, Agent, or Firm*—James J. Murphy; Winstead Sechrest & Minick

(57) ABSTRACT

A user customizable pendant that includes a frame with a hole, a transparent front window, and a back member, which may or may not also be transparent. The front window and back member couple to the frame to form a vessel with an inner cavity. The pendant includes a funnel coupled to the frame, with a hole at the bottom that provides access to the inner cavity ofthe pendant. The user customizes the pendant by placing real or simulated birthstones, other simulated stones, charms, or other small objects into the inner cavity through the funnel such that they are visible through the front window. In one embodiment, the funnel includes two aligned, transverse holes, through which a necklace, bracelet, chain, cord, ribbon, or other structure can be threaded that captures the objects inside the pendant. In another embodiment, the funnel is located at the side, and the pendant may or may not include a plug capable of being removably coupled to the funnel to block the bottom hole. Embodiments that include a side funnel also include a mounting ring, through which a necklace, bracelet, chain, cord, ribbon can be threaded to allow the user to wear or display the pendant.

23 Claims, 2 Drawing Sheets

CUSTOMIZABLE PENDANT

BACKGROUND OF THE INVENTION

1. Field of the Invention

The invention relates to the field of jewelry. More specifically, this invention relates to user customizable pendants.

2. Description of the Related Art

Ornamental jewelry has long been constructed of various materials, shapes and sizes according to various themes. Jewelry that displays the birthstone of the wearer has long been popular. In addition to jewelry that incorporates the birthstone of the wearer, jewelers have also created custom items using multiple birthstones. One such example of jewelry incorporating multiple birthstones is a "mother's ring" that is generally sold as a gift and incorporates the birthstone of each child of the woman to whom it is given. Similarly, pendants incorporating the birthstones of each child are also a popular sentimental gift.

Although these items incorporating multiple birthstones appeal to the consuming public, they are ordinarily custom made by jewelers and therefore costly. Additionally, such jewelry items can be altered only by a jeweler or one skilled in the art. The present invention discloses a pendant that allows for display of birthstones, other selected stones, charms, or other small objects, and is also easily customized.

The present invention comprises a pendant that includes a frame coupled to a front transparent window and a back member to form a vessel. In one embodiment, the back member comprises a transparent window. A funnel is permanently coupled to the frame and allows for the insertion of birthstones or other small objects into the vessel such that the objects are visible through the windows. In one embodiment of the present invention, the funnel includes transverse through holes that allow the pendant to be connected to a necklace, bracelet, or other structure for wearing or displaying the pendant, such as a chain, cord, or ribbon. When a necklace, bracelet, chain, cord, or other structure is threaded through the transverse holes in the funnel, the objects placed inside the pendant are securely captured inside the pendant.

In another embodiment of the pendant, the funnel is attached to one side. In this embodiment, the hole at the bottom of the funnel can be precisely sized such that the hole is large enough to allow birthstones or objects to be manually inserted into the pendant, but small enough to render it extremely unlikely that the objects will fall out. Alternatively, this embodiment can include a plug that fits within the funnel and blocks the hole, thus capturing the objects inside the pendant. All embodiments can display multiple birthstones, other selected stones, or other small objects. Unlike other jewelry pieces which are capable of displaying multiple birthstones or other stones, the present invention is easily customizable by the consumer.

SUMMARY OF THE INVENTION

The present invention comprises a user customizable pendant that includes a frame with a hole, a transparent front window, and a back member, which may or may not also be transparent. The front window and back member couple to the frame to form a vessel with an inner cavity. A funnel is coupled to the frame, such that the bottom hole of the funnel aligns with the hole in the frame, providing access to the inner cavity of the pendant. The user customizes the pendant by placing real or simulated birthstones, other simulated stones, charms, or other small objects into the inner cavity through the funnel and the funnel hole, such that they are visible through the front window. In one embodiment, the pendant is displayed or worn by threading it on a necklace, bracelet, chain, cord, ribbon, or other structure, through two generally aligned transverse holes through the funnel. In this embodiment, the necklace, bracelet, chain, cord, or ribbon prevents the objects within the inner cavity of the pendant from escaping.

In yet another embodiment, the funnel is located at the side of the pendant, and the pendant may or may not include a plug capable of being removably coupled to the funnel to block the bottom hole. Alternatively, the funnel bottom hole in this embodiment can be precisely sized such that it is large enough to allow objects to be inserted into the inner cavity of the pendant, but small enough to render remote the likelihood that the objects will fall out. Embodiments that include a side funnel also include a mounting ring, through which a necklace, bracelet, chain, cord, ribbon can be threaded to allow the user to wear or display the pendant.

BRIEF DESCRIPTION OF THE DRAWINGS

To further aid in understanding the invention, the attached drawings help illustrate specific features of the invention and the following is a brief description of the attached drawings.

DETAILED DESCRIPTION OF THE INVENTION

The present invention comprises a method and apparatus for an easily customizable pendant. This disclosure describes numerous specific details that include specific structures in order to provide a thorough understanding of the present invention. One skilled in the art will appreciate that one may practice the present invention without these specific details.

As described further herein, the pendant design provides the user an easy way to customize and modify the pendant to suit the user's preferences. FIGS. 1, 2 and 3 illustrate three different embodiments of the invention.

Figure 1A:
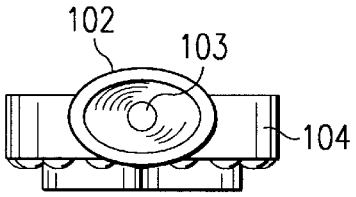
FIG. 1A is a top view of a heart shaped embodiment of the present invention.

FIG. 1A is atop view of a heart shaped embodiment of the pendant. The funnel 102 couples to the frame 104. The funnel hole 103 at the bottom ofthe funnel 102 aligns with a hole in the frame 104, allowing access to the inner cavity 107 between the front window 106 and the back member 108. Inner cavity 107, front window 106, and back member 108 are shown with greater clarity in FIG. 1D.

Figure 1B:
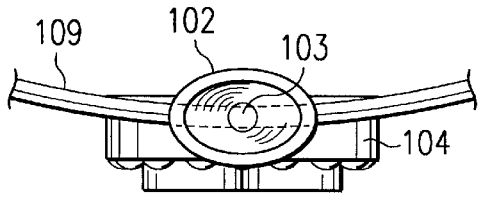
FIG. 1B is a second top view of a heart shaped embodiment of the present invention, shown attached to a display structure such as a necklace, bracelet, cord, chain, or ribbon (shown in phantom).

FIG. 1B illustrates the heart shaped embodiment ofthe pendant with the addition of a display structure 109, which is shown in phantom. Display structure 109 may be a necklace, bracelet, chain, cord, ribbon, or equivalent, that allows the user to wear and/or display the pendant. As shown in FIG. 1B, display structure 109 blocks bottom hole 103, thus capturing the contents of the pendant.

Figure 1C:
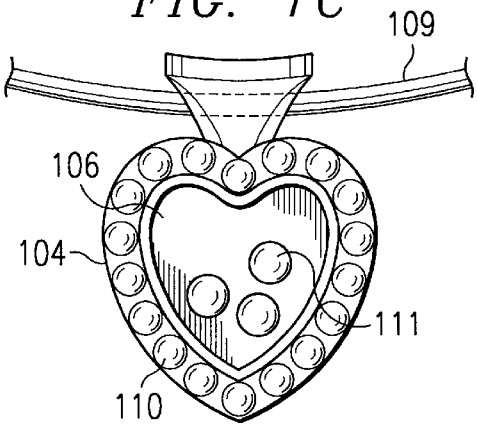
FIG. 1C is a front view of a heart shaped embodiment of the present invention.

FIG. 1C is a front view of a heart shaped embodiment of the pendant coupled to display structure 109 (in phantom). Front window 106, manufactured from a transparent material such as plexiglass, couples to frame 104, which optionally can include real and simulated birthstones 110 or other decorative elements. As shown in FIG. 1C, small objects such as real and simulated birthstones 111 that have been manually inserted through bottom hole 103 are visible through the front window 106. One skilled in the art will appreciate that small objects 111 may be real or simulated gemstones or semiprecious stones, charms, pebbles, or any small object that fits through bottom hole 103.

Figure 1D:
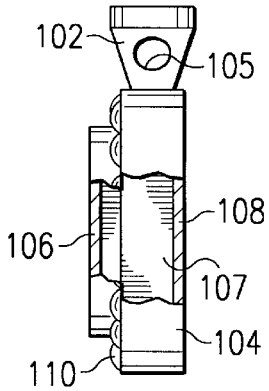
FIG. 1D is a cutaway side view of the present invention, showing the relationship between the frame, the front window, the back member, and the inner cavity.
Figure 2:
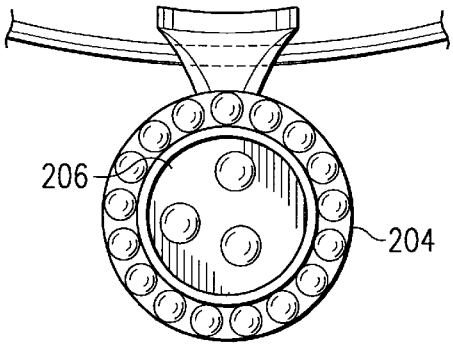
FIG. 2 shows the present invention in a circular embodiment.

FIG. 1D is a side view of a heart shaped embodiment of the pendant, with portions ofthe frame 104 cut away to show the front window 106, inner cavity 107, and back member 108. Funnel 102 includes generally aligned transverse holes 105, through which a display structure 109 can be threaded. As shown in FIG. 1D, transverse holes 105 are generally parallel to the plane of the frame 104.

Figure 1E:
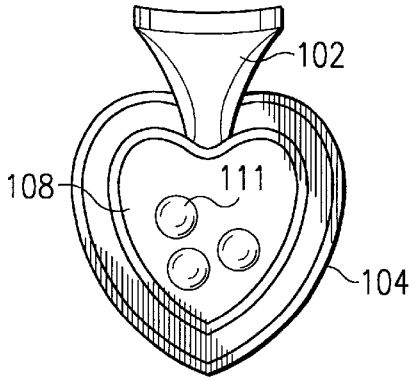
FIG. 1E is a back view of a heart shaped embodiment of the present invention.

FIG. 1E is a back view of an embodiment of the present invention wherein back member 108 comprises a transparent window manufactured from a transparent material such as plexiglass. As shown in FIG. 1E, in this embodiment of the present invention, small objects 111 that have been manually inserted into the pendant are visible through the back member 108. One skilled in the art will appreciate that the back member may be comprised of a transparent window, a solid window, or a structure such as a grill or a window which has perforations or holes to help reduce moisture buildup inside the inner cavity.

FIG. 2 shows an alternative embodiment of the present invention, wherein frame 204, front window 206, and back member 208 (not shown in FIG. 2) all comprise a circular shape rather than the heart shape shown in FIGS. 1A–1E. Those skilled in the art will recognize that the pendant may be embodied in a variety of shapes, including square, rectangular, diamond-shaped, oval, triangular, or even abstract, without departing from the present invention.

Figure 3A:
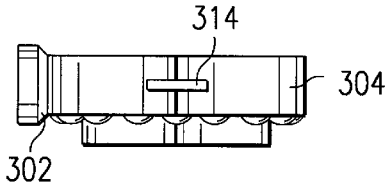
FIGS. 3A–3C show different views of a heart shaped embodiment of the present invention that includes a side funnel.
Figure 3B:
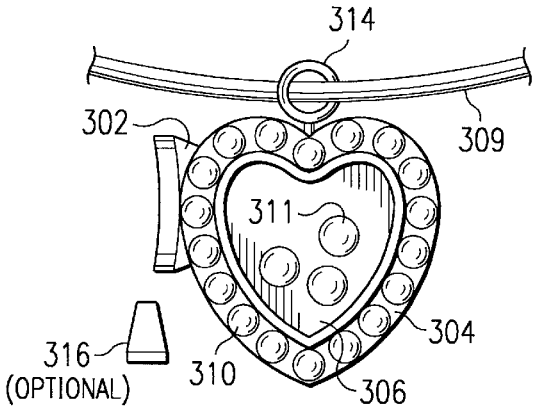
Figure 3C:
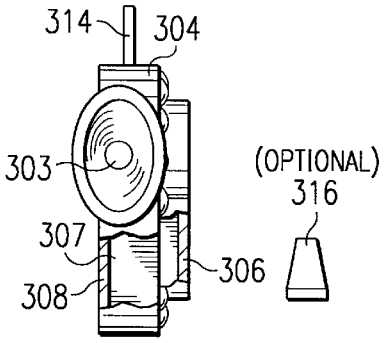

FIGS. 3A–3C show various views of a heart shaped embodiment of the invention that includes a side funnel 302. As shown in FIGS. 3A and 3B, the funnel 302 couples to the side of the frame 304 and a ring 314 is attached to the top of the frame 304, through which a display structure 309 can be threaded. As described previously in connection with FIG. 1B, display structure 309 may be a necklace, bracelet, chain, cord, ribbon, or equivalent, that allows the user to wear and/or display the pendant. FIG. 3B also shows front window 306, small objects 311, and optional decorative elements 310 attached to frame 304, all as described previously in connection with FIGS. 1A–1E. FIG. 3B also shows optional plug 316. In one embodiment, optional plug 316 may be removably coupled to funnel 302 to block hole 303 (shown in FIG. 3C), thus capturing small objects 311 inside the pendant. Alternatively, hole 303 can be precisely sized to be just large enough to allow small objects 311 to pass through hole 303, but small enough that it is extremely unlikely that small objects 311 can fall out of the inner cavity 307 of the pendant.

FIG. 3C is a cutaway side view of a heart shaped embodiment of the invention that includes a side funnel that shows hole 303 which provides access to inner cavity 307. FIG. 3C also shows front window 306, inner cavity 307, and back member 308.

To summarize, the present invention comprises a user customizable pendant that includes a frame with a hole, a transparent front window, and a back member, which may or may not also be transparent. The front window and back member couple to the frame to form a vessel with an inner cavity. A funnel is coupled to the frame, such that the bottom hole of the funnel aligns with the hole in the frame, providing access to the inner cavity of the pendant. The user customizes the pendant by placing real or simulated birthstones, other simulated stones, charms, or other small objects into the inner cavity through the funnel and the funnel hole, such that they are visible through the front window. In one embodiment, the pendant is displayed or worn by threading it on a necklace, bracelet, chain, cord, ribbon, or other structure, through two generally aligned transverse holes through the funnel. In this embodiment, the necklace, bracelet, chain, cord, or ribbon prevents the objects within the inner cavity of the pendant from escaping.

In yet another embodiment, the funnel is located at the side of the pendant, and the pendant may or may not include a plug capable of being removably coupled to the funnel to block the bottom hole. Alternatively, the funnel bottom hole in this embodiment can be precisely sized such that it is large enough to allow objects to be inserted into the inner cavity of the pendant, but small enough to render remote the likelihood that the objects will fall out. Embodiments that include a side funnel also include a mounting ring, through which a necklace, bracelet, chain, cord, ribbon can be threaded to allow the user to wear or display the pendant.

Other embodiments of the invention will be apparent to those skilled in the art after considering this specification or practicing the disclosed invention. The specification and examples above are exemplary only, with the true scope of the invention being indicated by the following claims.

We claim:

1. A user customizable pendant, comprising:

a vessel comprising a frame that includes a hole through said frame, a transparent front window, and a back member, forming an inner cavity; and a funnel coupled to said frame, said funnel further comprises a bottom hole that aligns with said hole through said frame, providing access to said inner cavity, and two aligned transverse holes generally parallel to a plane of said frame.

2. The pendant of claim 1 further comprising a display structure selected from the group consisting of necklaces, bracelets, chains, cords, and ribbons, said display structure threads through said two aligned, transverse holes in said funnel and blocks said bottom hole to capture the contents of said inner cavity.

3. The pendant of claim 1 further comprising a mounting ring coupled to said frame.

4. The pendant of claim 3 further comprising a plug removably coupled to said funnel.

5. The pendant of claim 1 wherein said back member further comprises a transparent window.

6. The pendant of claim 1 further comprising one or more objects capable of being inserted into said inner cavity through said bottom hole.

7. A user customizable pendant system, comprising:

a vessel comprising a frame that includes a hole through said frame, a transparent front window, and a back member, said transparent front window and back member couple to said frame to form an inner cavity; and a funnel coupled to said frame, said funnel further comprises a bottom hole that aligns with said hole through said frame, providing access to said inner cavity, and two aligned transverse holes generally parallel to a plane of said frame.

8. The system of claim 7 further comprising a display structure selected from the group consisting of necklaces, bracelets, chains, cords, and ribbons, said display structure threads through said two aligned, transverse holes in said funnel and blocks said bottom hole to capture the contents of said inner cavity.

9. The system of claim 7 further comprising a mounting ring coupled to said frame.

10. The system of claim 9 further comprising a plug removably coupled to said funnel.

11. The system of claim 7 wherein said back member further comprises a transparent window.

12. The system of claim 7 further comprising one or more objects capable of being inserted into said inner cavity through said bottom hole.

13. A method that makes a user customizable pendant, comprising:

providing a vessel comprising a frame that includes a hole therethrough, a transparent front window, and a back member to form an inner cavity; and coupling a funnel to said frame, said funnel further comprises a bottom hole that aligns with said hole through said frame, providing access to said inner cavity, and two aligned transverse holes generally parallel to a plane of said frame.

14. The method of claim 13 further comprising providing a display structure selected from the group consisting of necklaces, bracelets, chains, cords, and ribbons, said display structure threads through said two aligned, transverse holes in said funnel and blocks said bottom hole to capture the contents of said inner cavity.

15. The method of claim 13 further comprising coupling a mounting ring to said frame.

16. The method of claim 15 further comprising providing a plug capable of being removably coupled to said funnel.

17. The method of claim 13 wherein said back member further comprises a transparent window.

18. The method of claim 13 further comprising providing one or more objects capable of being inserted into said inner cavity through said bottom hole.

19. A method to use a customizable pendant, comprising:

obtaining a customizable pendant comprising a vessel that further comprises a frame that includes a hole therethrough, a transparent front window, and a back member forming an inner cavity, coupled to said frame is a funnel that further comprises a bottom hole that aligns with said hole through said frame, providing access to said inner cavity and two aligned transverse holes parallel to a plane of said frame; and inserting objects into said inner cavity through said funnel and said bottom hole.

20. The method of claim 19 further comprising threading a display structure selected from the group consisting of necklaces, bracelets, chains, cords, and ribbons through said two aligned, transverse holes in said funnel.

21. The method of claim 19 wherein said customizable pendant further comprises amounting ring coupled to said frame.

22. The method of claim 19 further comprising removably coupling a plug to said funnel.

23. The method of claim 19 wherein said back member further comprises a transparent window.

* * * * *